United States Patent [19]

Sacks

[11] 4,441,253

[45] Apr. 10, 1984

[54] TWO CYCLE SAFETY RAZOR

[76] Inventor: Charles H. Sacks, 18100 N. Atlantic Blvd., North Miami Beach, Fla. 33160

[21] Appl. No.: 496,282

[22] Filed: May 19, 1983

[51] Int. Cl.[3] ..... B26B 21/00

[52] U.S. Cl. ..... 30/32

[58] Field of Search ..... 30/40.1, 51, 52, 61, 30/62, 63, 64, 65, 79, 32, 34 R, 68, 69, 77, 79, 80

[56] References Cited

U.S. PATENT DOCUMENTS

| | | | |
|---|---|---|---|
| 1,916,416 | 7/1933 | Connolly | 30/65 |
| 2,121,000 | 6/1938 | Anderson | 30/40 |
| 3,587,171 | 6/1971 | Perry | 30/40.1 |
| 3,805,381 | 4/1974 | Broussard, Sr. | 30/34 A |

*Primary Examiner*—E. R. Kazenske
*Assistant Examiner*—Paul M. Heyrana, Sr.
*Attorney, Agent, or Firm*—Robert M. Schwartz

[57] ABSTRACT

A Two Cycle Safety Razor having a handle, platform, razor blade and cover plate. The platform having on its longer sides alternating teeth and slots preventing nicking of the shaven area from the blade edges. The alternating teeth and slots being of equal width. The razor assembly having a means to shift the blade the distance of one of said teeth, exposing at a slot a previously unused blade portion and simultaneously covering at a tooth a previously used blade portion, thereby utilizing a greater percentage of a razor blade's edge than heretofore obtained.

1 Claim, 8 Drawing Figures

TWO CYCLE SAFETY RAZOR

BACKGROUND OF THE INVENTION

1. Field of the Invention

The present invention relates to an improved safety razor assembly providing a substantial increase in the use and efficiency of the cutting edges of a razor blade inserted in a safety razor.

2. Description of the Prior Art

It is well known that many types of razor assemblies have been designed to safely hold in place a razor blade.

A conventional safety razor assembly includes a handle or post, to which is connected a blade support platform. Typically, this platform has two functions, first to hold the razor blade in place and second to prevent the razor blade from cutting the user. This is done by using a series of alternating slots and teeth that expose the edge of the blade at the slots yet the teeth prevent the blade from cutting the user. This is best shown in U.S. Pat. No. 2,632,243 entitled "Safety Razor", issued to J. T. Hellman on Mar. 24, 1953. Mr. Hellman's invention illustrates in FIG. 7 a base plate 30, having a series of alternating teeth, having rolled ridges 4 and slots 11. Furthermore, it can be seen that razor blade "B" is securely fitted on said base plate. Mr. Hellman's safety razor depicts the use of the safety razor in that when the blade becomes dull, it is disposed and a new blade is then used. The disposed blade typically has not been used along its entire edge, as in Mr. Hellman's invention, Rolled Ridges covered a large portion of the blade's edge. Thus for any blade, its maximum use is limited by the area under the protective teeth of the blade support platform.

Many improvements were made to extend shaving comfort and extend blade life, including the double edged razor blade and assembly as illustrated by Mr. Hellman's invention, to and including the razor illustrated by U.S. Pat. No. 3,587,171 entitled "Razor", issued to Roger I. Perry, on June 28, 1971. This razor discloses a novel advancing ribbon of blade 11. Typically, the base support platform 23 has a series of teeth-/ridges 88 and slots 92. However, Mr. Perry's invention does not use the portion of the blade covered by teeth 88.

Until the present invention, a razor with a safety guard assembly, having alternating series of teeth and slots, the actual use of an edge of a blade length was still less than 100%. This was caused by the teeth extending past the edge of the blade; the length of the blade edge covered by the tooth is not used. The present invention greatly increases the efficiency of blade use in a safety razor assembly.

Other patents describing the closest subject matter provide for a number of more or less complicated features that fail to solve the problem in an efficient and economical way. None of these patents suggest the novel features of the present invention.

SUMMARY OF THE INVENTION

It is the main object of this invention to increase the efficiency of razor blade usage in a razor assembly.

It is another object of this invention to provide a safe and reliable means of using the total edge of a razor blade in a razor assembly.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DESCRIPTION OF THE PREFERRED EMBODIMENT

Figure 1:
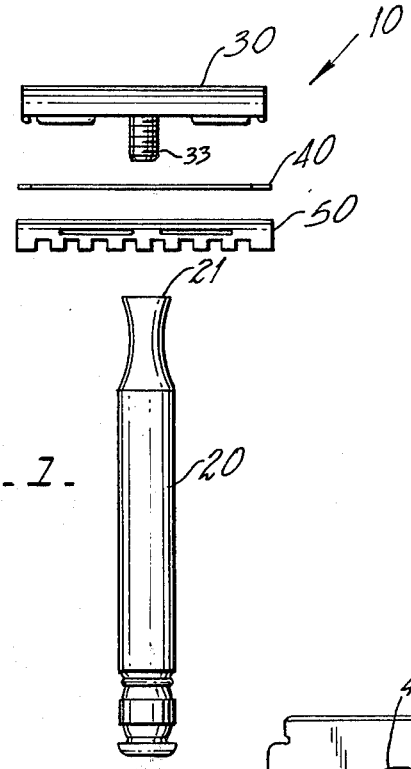
FIG. 1 shows an exploded view of the razor assembly.

Referring now to FIG. 1, where the Two Cycle Safety Razor is referred to, generally with numeral 10, it can be observed that it comprises a handle 20, a cover plate 30, a razor blade 40 and platform 50.

Figure 2:
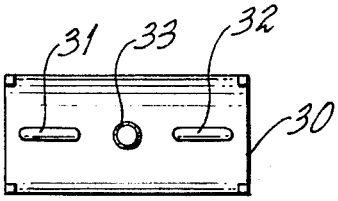
FIG. 2 is a bottom view of the cover plate.
Figure 3:
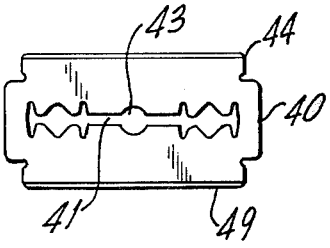
FIG. 3 is a top view of a double edge razor blade.

The cover plate 30, shown in FIG. 2, has horizontal guides 31 and 32 and center screw 33. Said center screw 33 is received by bore 21 in handle 20.

Razor blade 40, which can be either a single edged blade or, as in the preferred embodiment, a double edged blade aligns to the cover plate 30 by aligning horizontal opening 41 and center opening 43 with horizontal guides 31 and 32 and center screw 33, respectively.

Figure 4:
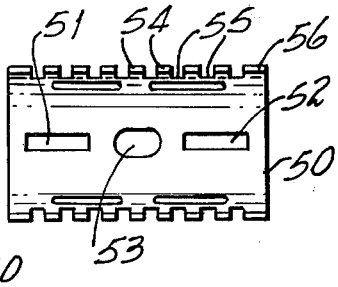
FIG. 4 is a top view of the platform.
Figure 6:
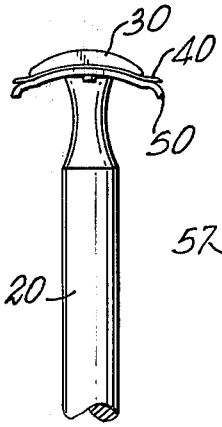
FIG. 6 is a partial end view of the razor assembly.

Platform 50 has horizontal openings 51 and 52 and center hole 53, causing said template 50 to align relative to the cover plate 30 and razor blade 40. As can be seen in FIG. 4, the longer parallel sides of platform 50 have alternating teeth 54 and slots 55. The width of a tooth 54 being equal to the width of a slot 55.

Figure 5:
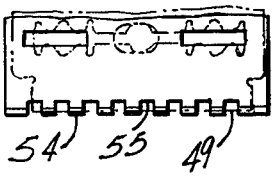
FIG. 5 is a partial view of the razor blade in relationship to the platform.

The edge 49 of razor blade 40 rests approximately half way between the outer edge of tooth 54 and the inner portion of slot 55, as shown in FIG. 5.

In the preferred embodiment, center hole 53 of platform 50 is elongated in a horizontal direction, and aligns on center screw 33. It can be noted that the horizontal length of center hole 53 exceeds the diameter of center screw 33 by a distance equivalent to the width of one tooth 54. Platform 50 can be shifted relative to razor blade 40.

The two cycle razor is assembled by aligning razor blade 40 and platform 50 with cover plate 30. Cover plate 30 is then releasably tightened onto handle 20 by screwing center screw 33 into bore 21.

When in use, teeth 54 direct the facial hair through slots 55, causing the edge 49 of razor blade 40 to cut the hair. Teeth 54 protect the skin from being nicked or cut by the razor blade 40.

The two cycle safety razor is used in the first cycle with the platform 50, tightened so as to have one edge of center hole 53 against center screw 33. When the blade becomes dull, the razor assembly is loosened and platform 50 is manually pushed over causing the opposite end of center hole 53 to be against center screw 33. The previously unexposed edges of razor blade 40 are now exposed at slots 55 and those previously used edges of razor blade 40 are now covered by teeth 54. The two cycle razor assembly is now in cycle 2.

By moving platform 50 relative to razor blade 40, exposing previously unexposed edges of said razor blade 40 and simultaneously covering the previously exposed edges of said razor blade 40 it is possible to use the entire razor blade edges, getting approximately 100% usage of the razor blade.

Figure 7:
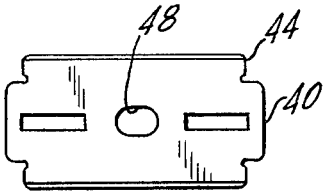
FIG. 7 is a top view of an alternate double edge razor blade.
Figure 8:
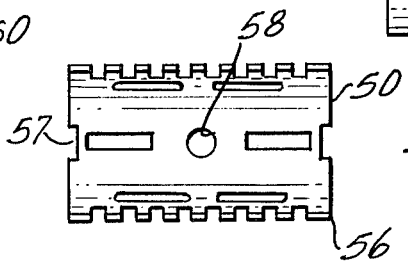
FIG. 8 is a top view of an alternate platform.

The key to the two cycle safety razor is to shift the platform 50 relative to the razor blade 40 a distance equal to one tooth 54. Therefore, as shown in FIG. 7 and FIG. 8, the center hole 48 of razor blade 40 can be elongated and the center hole 58 of platform 50 can be equivalent to the size of center screw 33. In this alternative method, when the razor assembly 10 is loosened, blade 40 is shifted relative to platform 50. Notch 57 provides access so that razor blade 40 can be easily shifted from cycle 1 to cycle 2.

It can be further noted that no matter how the razor blade 40 is shifted relative to the platform 50, it is necessary that the platform 50 have large corner teeth 56 in order to prevent the corner 44 of razor blade 40 from extenting past the edge of said platform 50.

It is believed the foregoing description conveys the best understanding of the objects and advantages of the present invention. Different embodiments may be made of the inventive concept of this invention. It is to be understood that all matter disclosed herein is to interpreted merely as illustrative, and not in a limiting sense, except as set forth in the following appended claims.

What is claimed is:

1. A safety razor comprising in combination (a) a platform having its length greater than its width, said platform having a series of alternating slots and teeth along the edges of its longer sides, the width of each of said teeth being equal to the width of each of said slots;

(b) a cover plate substantially the same size as said platform to cooperate with said platform, having horizontal guides and a center screw;

(c) a razor blade substantially the same size as said platform to cooperate with said platform and said cover plate;

(d) an elongated handle to receive said center screw, releasably connecting to said platform, said razor blade and said cover plate;

(e) a means to manually shift said razor blade a length of one of said teeth relative to said platform, exposing said lengths of said razor blade's edge previously unused, and the previously used lengths covered by said teeth of said platform; and (f) said means to shift said razor blade relative to said platform includes an oblong center opening in said platform having its larger diameter equal to the diameter of said center screw plus the width of one of said teeth of said platform, whereby said razor assembly is loosened such that said platform is shifted relative to said center screw.

* * * * *